US006535202B1

(12) United States Patent
Amari et al.

(10) Patent No.: US 6,535,202 B1
(45) Date of Patent: Mar. 18, 2003

(54) DISPLAY SCREEN SWITCH

(75) Inventors: Takeyuki Amari, Shizuoka-ken (JP); Yoshiyuki Furuya, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 196 days.

(21) Appl. No.: 09/679,634

(22) Filed: Oct. 5, 2000

(30) Foreign Application Priority Data

Oct. 8, 1999 (JP) ..... 11-288758

(51) Int. Cl.[7] ..... G09G 5/00

(52) U.S. Cl. ..... 345/173; 345/170; 345/168; 341/22; 341/23

(58) Field of Search ..... 345/87, 173, 170, 345/156, 172, 158, 168, 179; 341/22, 23

(56) References Cited

U.S. PATENT DOCUMENTS 4,487,481 A * 12/1984 Suzawa ..... 350/345
5,063,379 A * 11/1991 Fabry et al. ..... 340/784
5,143,433 A * 9/1992 Farrell ..... 362/29
5,235,636 A * 8/1993 Takagi et al. ..... 379/368
5,390,093 A * 2/1995 Himeno et al. ..... 362/249
5,596,343 A * 1/1997 Snider ..... 345/102
6,297,810 B1 * 10/2001 Anderson ..... 345/173

* cited by examiner

*Primary Examiner*—Richard Hjerpe
*Assistant Examiner*—Kimnhung Nguyen
(74) *Attorney, Agent, or Firm*—Finnegan, Henderson, Farabow, Garrett & Dunner, L.L.P.

(57) ABSTRACT

A display screen switch of the present invention includes: a plate-like case arranged on a display screen and provided with a transmit-light window part in which switch information displayed on the display screen is transmitted; a switch body fixed to the case; a cover arranged on an upper side of the case and having a hole part; a transmit operational member including a transparent display part which transmits a visible light and on which the switch information is displayed, and a switch push-down part which makes the switch body operate; and an elastic member interposed between the transmit operational member and the case along a circumference part of the transmit operational member. The transmit operational member being arranged such that the transparent display part and the switch push-down part are arranged in a protruding way from the hole part between the cover and the case. Especially, the elastic member and the transmit operational member are bonded by an adhesive.

11 Claims, 10 Drawing Sheets

DISPLAY SCREEN SWITCH

BACKGROUND OF THE INVENTION

The present invention relates to a display screen switch, and more particularly to a display screen switch to be operated on a display screen on which switch information is displayed.

In recent years, in order to make a switch function a multi-purpose type, there was proposed a display screen switch to be operated on a display screen on which switch information is displayed.

As a display screen switch, there are some types of switches, such as a touch panel type which pushes down a touch panel itself on the display screen and another type which pushes down a transmit operational member on the display screen to make a contact type switch operate, or the like. The touch panel type lacks an input sense, as there is little operational stroke based on the push-down operation, but the type using the transmit operational m and a contact type switch does not lead to such disadvantage, as an operational stroke due to the push-down motion is enough.

SUMMARY OF THE INVENTION

The present inventors previously investigated and proposed a structure in which a display screen switch using the transmit operational member and a contact type switch was used (Japanese Patent Application No. 11-149295: not prior art).

In FIGS. 8 to 11, a display screen switch 1 includes a plate-like case 3 arranged on a display screen 2*a* of a liquid crystal display 2, a plurality of switch bodies 4 fixed to the case 3, a transmit operational plate 5 as a plurality of clear keys arranged on the outside of the case 3, a rubber 6 as a sheet-like elastic member intervened between a plurality of transmit operational plates 5 and the case 3, and a cover 7 for supporting each transmit operational plate 5.

The case 3 is made of ABS resin or polycarbonate resin, and includes a plate-like case body 3*a* arranged on a display screen 2*a*, and a plurality of juxtaposed transmit-illuminate windows 3*b* which are formed on the case body 3*a* so as to penetrate the case body 3*a* between the topside and the underside and through which switch information displayed on the display screen 2*a* is transmitted and illuminated to the transmit operational plate 5 side.

A plurality of switch bodies 4 are fixed to the respective positions of the case body 3*a* corresponding to a plurality of juxtaposed transmit-illuminate windows 3*b* and each switch body 4 has a contact using a metal contact.

Each transmit operational plate 5 includes a transparent display part 10 in which switch information is passed through transparently and displayed, a switch push-down part 11 provided on one side of the transparent display part 10, a flange 12 provided over all the outside circumference of both transmit display part 10 and switch push-down part 11, and an engagement wall part 13 provided extendedly at the down side of the flange 12. Each transmit operational plate 5 is made of, for example, methacryl (acryl resin) or polycarbonate resin.

In the transparent display part 10, a part which is required to transmit a light and a part which is not required to transmit a light are formed by a so-called two-color molding method of a transparent element and an opaque element. Further, in FIG. 10 and FIG. 11, a part which transmits a light is illustrated by a broken line hatching, while a part which prevents outer light leakage is shown by an ordinary resin-hatching. A top face 10*a* of the transparent display part 10 is a key top.

A rubber 6 is made of, for example, silicone gun and on the top face of the rubber 6, a plurality of holes 6*a* are arranged. An engagement wall 13 of each transmit operational plate 5 is inserted into each hole 6*a*, respectively and the rubber 6 is engaged with each transit operational plate 5 to exhibit its elasticity.

A cover 7 is made of ABS resin or polycarbonate resin and includes a plate-like cover body part 7a and a plurality of juxtaposed operational plate holes 7*b* which are formed on the cover body 7*a* so as to penetrate from both sides. The upper parts of the transparent display part 10 and the switch push-down part 11 of the transmit operational plate 5 are protruding from the operational plate hole 7*b*. The flange 12 of the transmit operational plate 5 is stuck to the case 3 by an elastic force of the rubber 6. That is to say, a distance between an upper face of the case 3 and a lower face of the cover 7 is set in response to a dimension a little less than a distance between a lower face of the rubber 6 in a free condition (in no load state) and an upper face of the flange 12 of transmit operational plate 5, and thus the transmit operational plate 5 is mounted downward in a little displaced way against an elastic force of the rubber 6. In FIG. 10 and FIG. 11, reference numeral 14 is a face part.

In the above constitution, a many sorts of information is selectively displayed on the display screen 2*a* of the Liquid crystal display 2, and switch information is displayed in a specified part of the display screen 2*a* corresponding to a plurality of transmit operational plate 5. A plurality of switch information shown on the display screen 2*a* is transparently displayed on the surface of the transparent display part 10 in every transmit operational plate 5. An operator looks at it and pushes a switch push-down part 11 of a desired transmit operational plate 5. Then, the switch push-down part 11 displaces downward by an elastic deformation of the rubber 6, and the switch push-down part 11 correspondingly pushes down the switch body 4 to activate the switch body 4.

In the course of the operation, the plate-like case 3 and the thin transmit operational plate 5 are arranged in a multilayer state on the display screen 2*a* of the liquid crystal display 2 to activate the switch body 4 fixed to the case 3 by the push-down operation of the transmit operational plate 5. Therefore, since a distance between the display screen 2*a* and an upper surface 10*a* of the transparent display part 10 in the transmit operational plate 5 which corresponds to a key top is short, an operator can easily observe switch information shown on the display screen 2*a*.

If the switch push-down part 11 of the transmit operational plate 5 is pushed down, the rubber 6 is downward elastically deformed to activate the switch body 4, while if the push operation of the switch push-part 11 is stopped, the rubber 6 returns to the original position due to elastic return/deformation. And the rubber 6 is arranged under the all circumference of the transmit operational plate 5 and the rubber 6 is stuck to the transmit operational plate 5 due to its elastic reaction. Therefore, it is possible to prevent dust, water, or the like which entered into an operational hole part 7*b* of the cover 7 from entering inside.

Nevertheless, in the display screen switch 1 as investigated above, as the transmit operational plate 5 and the rubber 6 are only stuck thereto by an elastic reaction of the rubber 6 or the like, it may be supposed that after assembled, the transmit operational plate 5 produces a positional slide due to vibration or the like.

To solve the above problems, the present invention has been proposed and it is an object of the present invention to provide a display screen switch in which a transmit operational plate does not produce a positional slide after built-in and a good assembly accuracy can be obtained.

Specifically, a display screen switch of the present invention comprising: a plate-like case arranged on a display screen and provided with a transmit-light window part in which switch information displayed on the display screen is transmitted; a switch body fixed to the case; a cover arranged on an upper side of the case and having a hole part; a transmit operational member including a transparent display part which transmits a visible light and on which the switch information is displayed, and a switch push-down part which makes the switch body operate; and an elastic member interposed between the transmit operational member and the case along a circumference part of the transmit operational member. The transmit operational member is structred such that the transparent display part and the switch push-down part are arranged in a protruding way from the hole part, between the cover and the case. Especially, the elastic member and the transmit operational member are bonded by an adhesive.

DETAILED DESCRIPTION OF THE PREFERRED EMBODIMENTS

Embodiments of a display screen switch according to the present invention are described in detail below, with references being made to relevant accompanying drawings. In each embodiment, a structure in which the present invention is applied to a display screen switch for the on-vehicle electrical equipment, will be described typically.

First, with reference to FIGS. 1 to 5, a first embodiment of the present invention will be described in detail.

Figure 1:
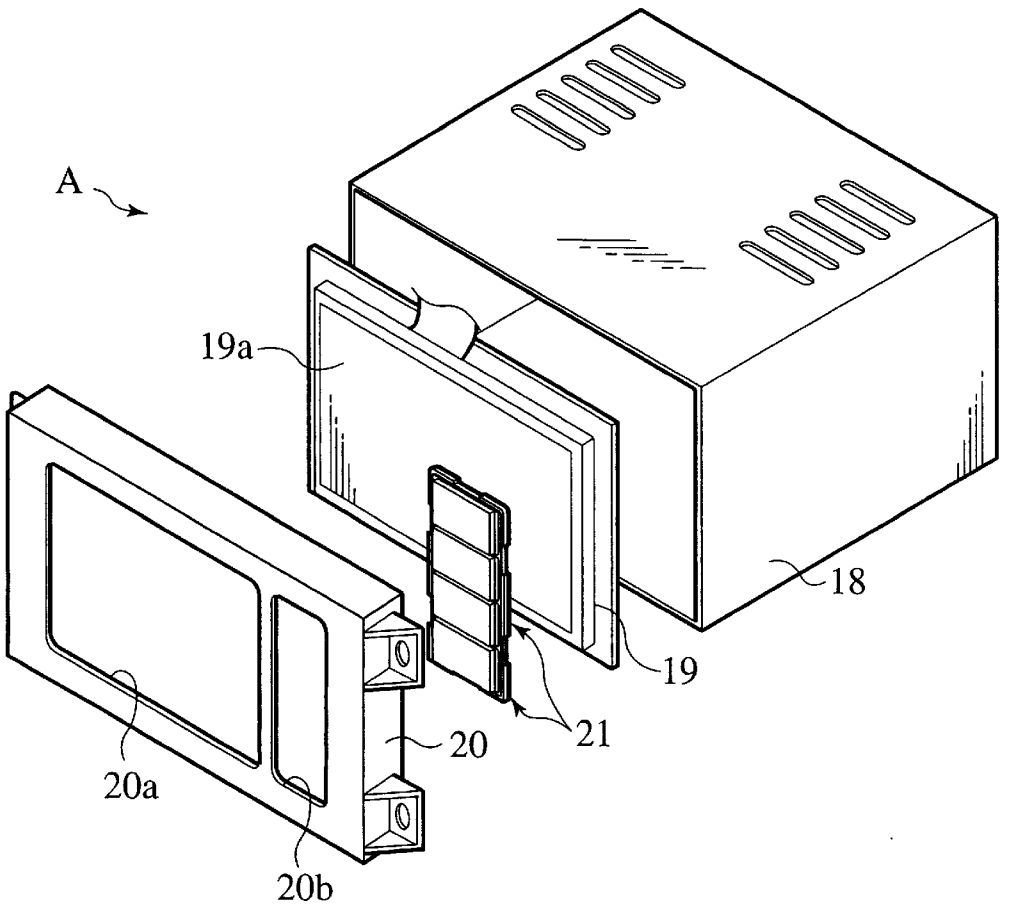
FIG. 1 is an exploded perspective view of an on-vehicle electrical equipment to which a display screen switch according to a first embodiment of the present invention is applied.

In the on-vehicle electrical equipment A of FIG. 1, CD players and cassette drives or the like (not shown) are integrated in a case 18 which is formed by sheet metal work and is front-opened, and before the case, a liquid crystal display 19 as a display means is provided.

The liquid crystal display 19 can display a multifarious information including switch information on a display screen 19*a*.

On the front side of the liquid crystal display 19, a face cover 20 is arranged as a cover, and a large aperture part 20*a* which is provided in the face cover 20, so as to be able to look at the display contents of the liquid crystal display 19 and further, an aperture part 20*b* for an operational plate is annexed in the neighborhood.

A key top of the display screen switch 21 is arranged in a protruding state from the aperture part 20*b* for an operational plate in the face cover 20.

More detailed description of the display screen switch will be given hereafter. As shown in FIG. 2 to FIG. 5, the display screen switch 21 includes: a plate-like case 22 arranged and fabricated on the display screen 19*a* of the liquid crystal display 19; a flat cable 23 fixed onto the case 22; a transmit operational plate 24 which forms a plurality of clear keys arranged on the front side of the case 22; a rubber 25 of sheet-like elastic member which is interposed between a plurality of transmit operational plates 24 and the case 22; a square frame-like base 26 which presses down the outer circumference part of the rubbers 25 from upward; and the above noted face cover 20 which presses dawn the base 26 and the transmit operational plates 24 from upward.

The case 22 is made of a cold rolled steel and includes: a plate-like case body 22*a* which is arranged on the display screen 19*a* and has a stand-up wall on its outer circumference part; and a plurality of juxtaposed transmit-illuminate window part 22*b* which is formed on the case body 22*a* so as to penetrate the case body 22*a* between its topside and underside, and switch information displayed on the display screen 19*a* is transmitted and illuminated to the transmit operational plate 24 side through the transmit-illuminate window part 22*b*. The surface of the case 22 is colored into black by black chromate coating treatment as a kind of metal plating. This treatment is to prevent effectively reflection of a visible light.

At a plurality of places in the flat cable 23, metal domes 23*a* (refer to FIG. 2) each as a switch contact are arranged and a plurality of switch bodies 30 are constituted by several metal domes 23*a* and a wiring (not shown) on a flat cable 23. The plural switch bodies 30 are provided at positions corresponding to a plurality of juxtaposed transmit-illuminate window part 22*b*, respectively.

Figure 2:
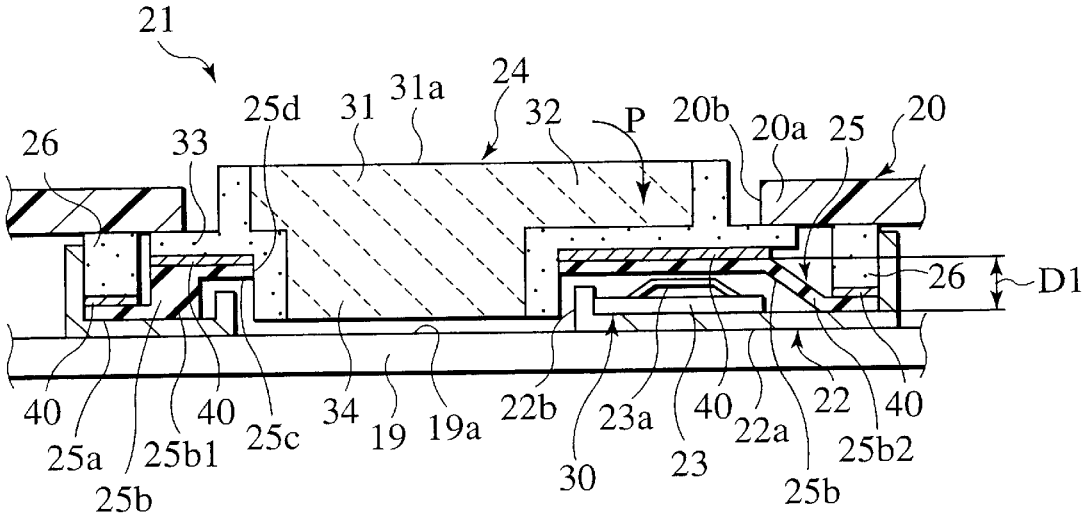
FIG. 2 is a cross-sectional view of the display screen switch according to the first embodiment.
Figure 3:
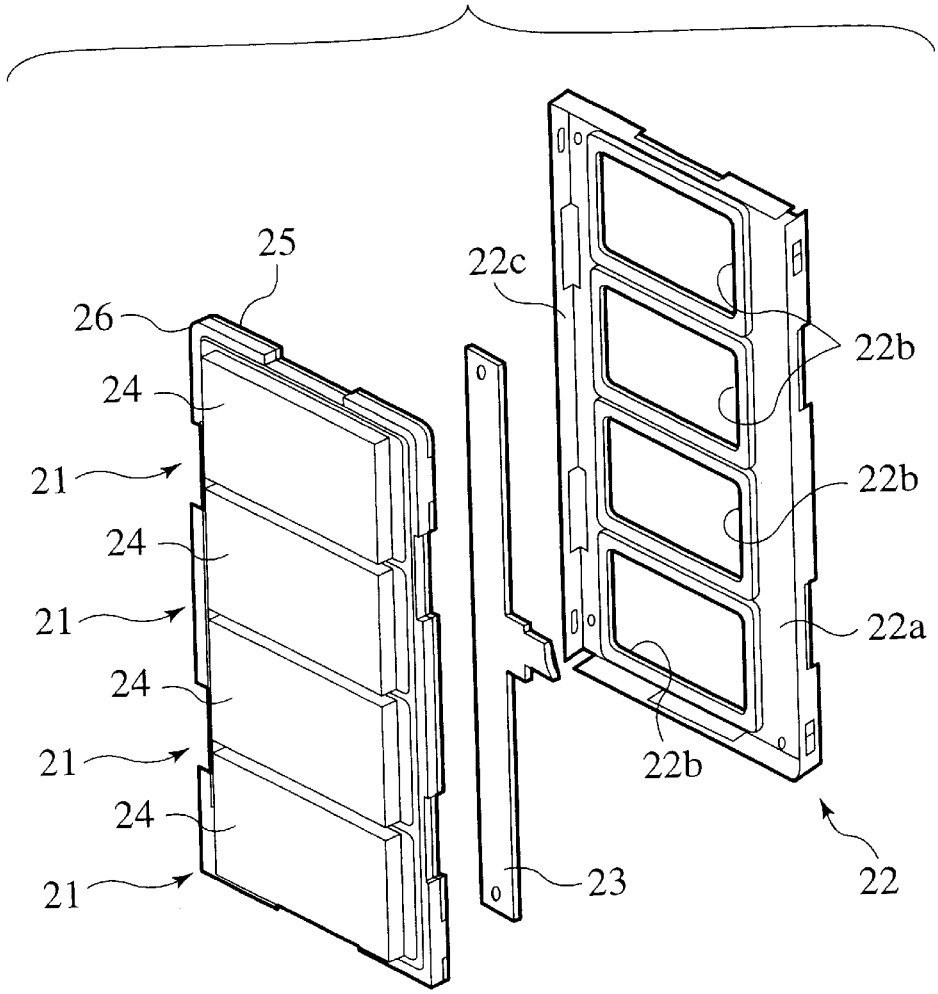
FIG. 3 is an exploded perspective view of the display screen switch according to the first embodiment.
Figure 4:
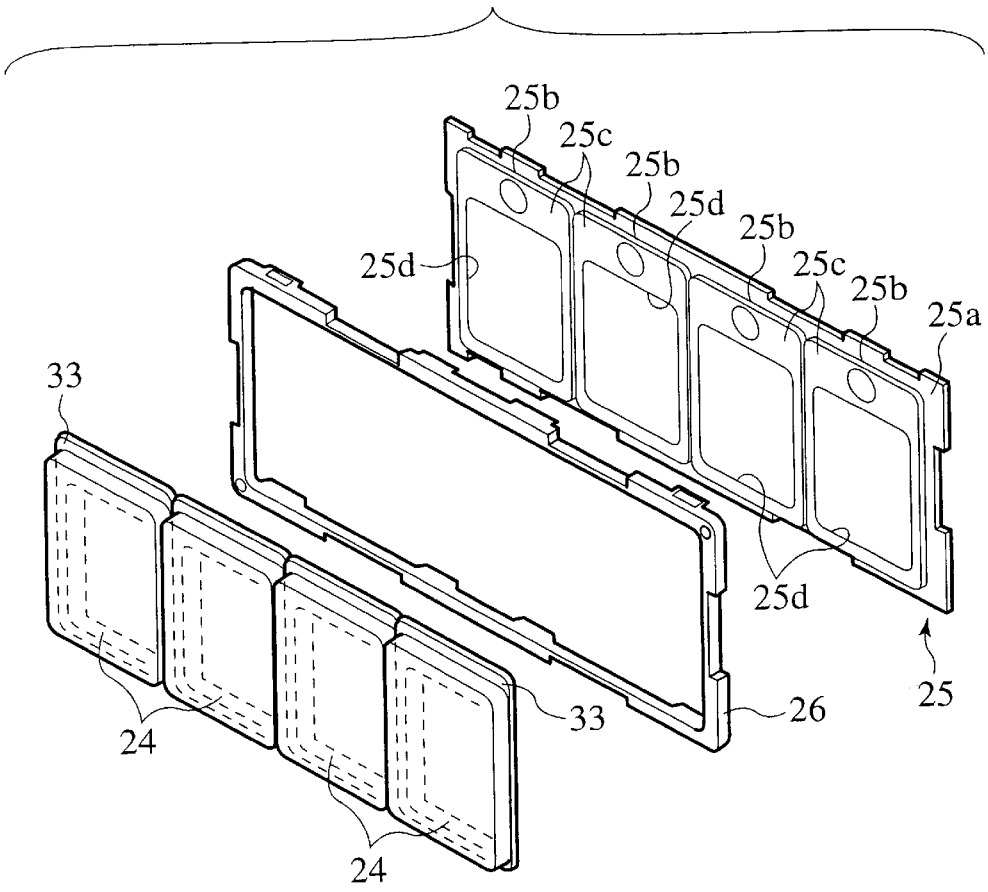
FIG. 4 is a partially exploded perspective view of the display screen switch according to the first embodiment.

As shown in FIG. 2, each transmit operational plate 24 includes: a transparent display part 31 in which switch information displayed on the display screen 19*a* is transmitted and displayed; a switch push-down part 32 provided on one side of the transparent display part 31; a flange part 33 provided over all the circumference of the transparent display part 31 and switch push-down part 32; and an engagement wall part 34 extended at the lower side of the flange part 33. Each transmit operational plate 24 is made of, for example, transparent resin such as polycarbonate resin (PC resin) which has a refractive index higher than air and is formed to make the thickness as thick as possible. By such a structure that the resin of higher refractive index than air is molded thickly, since the display on the display screen 19*a* appears to rise and float to the surface than in case of the air layer, the display is easily to be seen. That is to say, since the refractive index is higher than air and the surface to be recognized by an eye appears to float higher than in the air layer only, it is possible to take a display letter of the display device to a place where easily seen.

Figure 5:
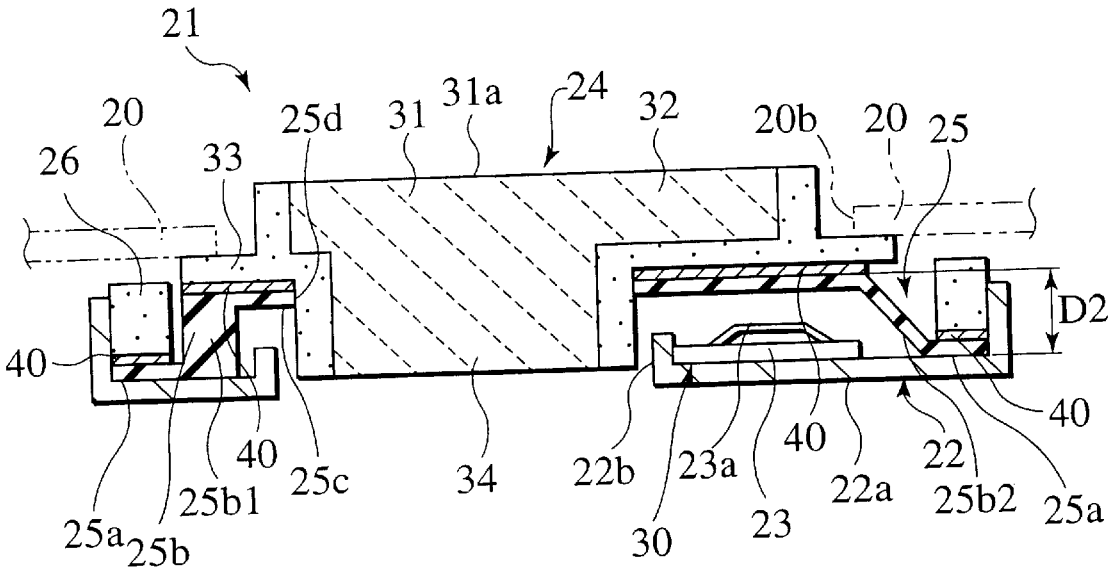
FIG. 5 is a sectional view showing a state before a rubber is compressed of the display screen switch according to the first embodiment.

Regarding each transmit operational plate 24, it is possible to form its entire structure by a transparent member. Nevertheless, in the present embodiment, a first part that is required to transmit a visible light and a second part that is difficult to transmit a visible light, that is opaque, are formed by so-called two-color molding method by use of a transparent member and a non-transparent member. In FIG. 2 and FIG. 5, the transparent member part which transmits a visible light in the transmit operational plate 24 is shown by use of a broken line hatching, while the non-transparent member part for preventing light leakage due to total reflection or the like in the transmit operational plate 24 is shown by use of a set of black points. To put it specifically, the transmit member part is so-called gray-smoke-like and its light-transmittance is about 40%.

In this case, the non-transparent part is provided around the transparent part so as to prevent from entering of a light from other than an upper face of the transparent display part 31 and thereby preventing shining at the edge of the corner of the transmit operational plate 24 (a light passing through the inner part concentrates at the edge by total reflection and thus the edge shines). This is also for preventing an ultraviolet light hardening adhesive 40 bonding the transmit operational plate 24 and the rubber 25 from being observed, so as to be invisible to the naked eye.

An upper face 31*a* of the transparent display part 31 and the switch push-down part 32 of the transmit operational plate 24 becomes a key top.

At the upper face 31*a* of the transparent display part 31 and the switch push-down part 32 and also its circumferential side, hard coating treatment is effected in order to harden its surface hardness (for example, hardness that even with nails or many numbers of operation, one cannot injure, that is, so-called pencil hardness is nearly 2H.) When injured at the transparent display part 31, as the display becomes difficult to be observed, in order to prevent it, such hard coating treatment is utilized. Especially regarding the on-vehicle electrical equipment A, since a deterioration of visible acknowledgement results in bad effects for a drive operation, it is necessary not to injure the face of a display unit.

The rubber 25 is made of silicone rubber and has an optical characteristic that an ultraviolet light which is used to harden the ultraviolet light hardening adhesive 40 can be transmitted. The rubber 25 is gray-smoke-like and has about 40% of optical transmittivity. The rubber 25 includes a lower face part 25*a* for contacting with an upper face of the case 22, a plurality of stand-mounting parts 25*b* for stand-mounting at positions corresponding to the circumference of the transmit operational plate 24 from the lower face part 25*a*, and a plurality of upper face parts 25*c* arranged at the upper end of each stand-mounting part 25*b*. A rectangular hole 25*d* is formed on each upper face part 25*c*. The engagement wall part 34 of each transmit operational plate 24 is inserted into each hole 25*d*, respectively and the rubber 25 is arranged in a compressed state (in a state such that a reaction of rubber contractional pressure may act) between each transmit operational plate 24 and case 22.

As shown in detail in FIG. 2, regarding the stand-mounting part 25*b* of the rubber 25, a stand-mounted section 25*b*1 on the transparent display 31 side extends vertically to the lower face part 25*a* and the upper face part 25*c* and also is constructed thickly, while a stand-mounted part 25*b*2 on the switch push-down 32 side is inclined to the lower face part 25*a* and the upper part face 25*c* and also is constructed thinly.

The base 26 is made of, for example, polycarbonate resin and constructed as black and opaque. The base 26 is engaged therewith in a side wall part 22*c* of the case 22 and is thus positioned with respect to the case 22. In FIGS. 2 and 5, base 26 is a member that does not substantially transmit a visible light and is shown by use of a set of black points.

The face cover 20 is composed of ABS resin or polycarbonate resin and as described above, upper parts of the transparent display part 31 and the switch push-down part 32 of the transmit operational plate 24 protrudes from the aperture part 20*b* for the operational plate.

The flange part 33 of the transmit operational plate 24 is stuck to a lower face of the face cover 20 by an elastic force of the rubber 25. That is to say, after an assembly that an upper face of the case 22 is opposed with a lower face of the face cover 20, a space D1 (as shown in FIG. 2) between a lower face of the lower face part 25*a* in the rubber 25 and an upper face of the upper face part 25*c* is set to a scale which is smaller than a space D2 that is in no load state before assembly by a predetermined amount. The transmit operational plate 24 is mounted in a state that the rubber 25 is previously compressed downward.

Further, each transmit operational plate 24 and each upper face part 25*c* of the rubber 25 and also the base 26 and the lower face part 25*a* of rubber 25 are adhered by the ultraviolet light hardening adhesive 40 which is hardened by an irradiation of an ultraviolet light.

Based on the above construction, an operation of the display screen switch according to the present Edict will be described.

Multifarious information is selectively displayed on the display screen 19*a* of the liquid crystal display unit 19, while switch information is shown on a responding area of the display screen 19*a* corresponding to a plurality of transmit operational plate 24.

A plurality of switch information shown on the display screen 19*a* is transmit-displayed on the surface side of the transparent display part 31 of each transmit operational plate 24 and when an operator observes it to push dawn the switch push-down part 32 of a desired transmit operational plate 24, as shown by an arrow P in FIG. 2.

Thus, the switch push-down part 32 can be displaced downward by an elastic deformation of the rubber 25 and the switch push-down part 32 pushes down the metal dome 23*a* to activate the switch body 30.

Then, if one stops to push down the switch push-down part 32, the transmit operational plate 24 returns to an original position by an elastic return-deformation of the rubber 25.

As described above, in the display screen switch 21 according to the embodiment, as the transmit operational plate 24 and the rubber 25 are adhered by the ultraviolet light hardening adhesive 40, it is prevented that transmit operational plate 24 shifts its position to the rubber 25 by a vibration or the Like. As a result, the transmit operational plate 24 does not bring about the shift of position after assembly and an accuracy of assembly can be excellent.

Since the ultraviolet light hardening adhesive 40 is used as a glue for the transmit operational plate 24 and the rubber 25 or the like, a short hardening time will be enough, with compared to a case where another glue is used, and a working condition is improved. That is to say, in a thermosetting adhesive (silicone series), its adhesive strength is high and if an integrated molding is effected, its accuracy is high, but the hard coating of the key top is in tendency to be influenced by heat in its hardening process. And as for a wet hardening adhesive, as its hardening time is long, it leads to a cost-up. As for an instantaneous adhesive, its working efficiency is inclined to become worse in order to adhere the rubber 25 and the key top without an air gap.

As a space between the base 26 and the rubber 25 which is positioned by the case 22, is adhered by the ultraviolet light hardening adhesive 40 and the transmit operational plate 24 is positioned to the case 22 through the base 26, an accuracy for assemblage is better. Specifically speaking, in a case of assembly of the display screen switch 21, the transmit operational plate 24, rubber 25 and base 26 are assembled together, such an assembled component is assembled to the case 22 and in this course of assembly, the transmit operational plate 24 is positioned to the case through the base 26, thus a component with a good accuracy for positioning can be obtained.

The rubber 25 is made gray-smoked and the case 22 is made black by the black chromate treatment. As the rubber 25 is gray-smoked, if the periphery of the transmit operational plate 24 is constructed as an opaque part, it is possible to irradiate the ultraviolet light from the rubber 25 side to a bonding surface between the rubber 25 and the transmit operational plate 24, and after assembly, as the case 22 is made black, a light entered into the rubber 25 among external lights can be prevented to reflect in the case 22. Therefore, the display screen becomes easier to see than ever.

Since the rubber 25*a* in compressed state is interposed between each transmit operational plate 24 and the case 22, and the elastic force of the rubber 25 is acting constantly to each transmit operational plate 24, an abnormal noise which could be produced by vibration or the like would be eliminated.

As for the stand-mounting part 25*b* of the rubber 25, since the stand-mounting part 25*b*1 on the transmit operational plate side (on the opposite side of the switch push-down part) of each transmit operational plate 24 extends vertically to the lower face part 25*a* and the upper face part 25*c* and is constructed thickly, while the stand-mounting part 25*b*2 on the switch push-down side of each transmit operational plate 24 is inclined to the lower face part 25*a* and the upper face part 25*c* and is constructed thinly. As shown by an arrow P in FIG. 2, if the switch push-down part 32 of the transmit operational plate 24 is pushed down, making the thick side stand-mounting part 25*b*1 as a fulcrum, the thin side stand-mounting part 25*b*2 is elastically deformed and displaced downward to be able to activate the switch body 30 certainly. Therefore, since the switch body 30 can be activated by the rubber 25 only, without adding a mechanical hinge structure thereto, the display screen switch 21 can be constructed thinly.

Next, a display screen switch according to the second embodiment of the present invention will be described mainly with reference to FIG. 6.

Regarding the display screen switch of the second embodiment with comparing to the first embodiment, as a bonding structure between the rubber 25 and the transmit operational plate 24 is different and the other constitutions are the same as the first embodiment, the different points only will be described in detail, the same points will be omitted suitably, and the same signature will be attached to the same components.

Specifically, in addition to the first embodiment, in a bonding surface between the rubber 25 and the transmit operational plate 24, a convex part 41 is formed in the rubber 25 and a concave part 42 into which the convex part 41 correspondingly enters is formed in the transmit operational plate 24.

Figure 6:
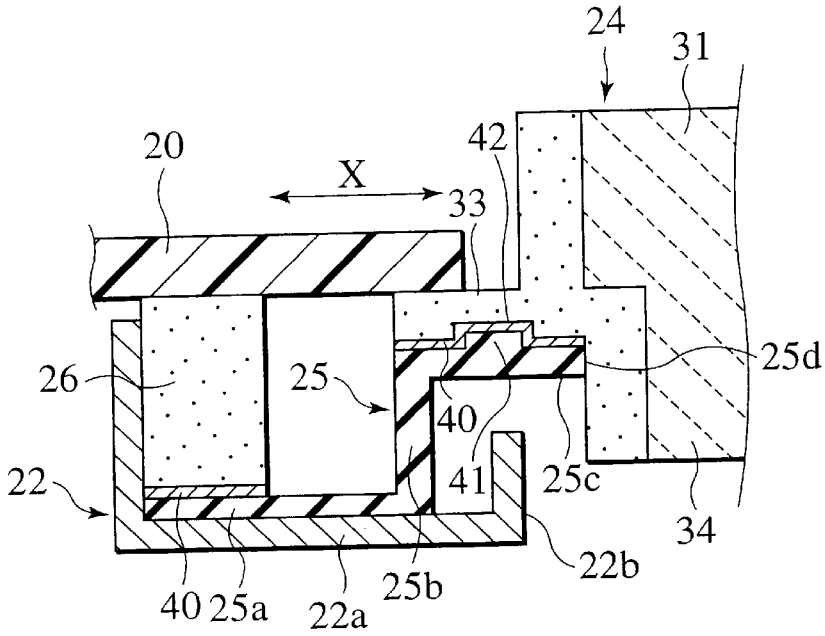
FIG. 6 is a mainly enlarged cross-sectional view of a display screen switch according to a second embodiment of the present invention.

Therefore, according to the second embodiment, since each bonding area between the rubber 25 and the transmit operational plate 24 is widened, an attaching force in a direction indicated by an arrow X in FIG. 6 is increased and thus so-called peeling strength is enhanced the more.

Further, in the second embodiment, a convex part 41 may be formed in the transmit operational plate 24 and a concave part 42 may be formed in the rubber 25.

Next, a display screen switch according to a third embodiment of the present invention will be described mainly with reference to FIG. 7.

Regarding the display screen switch of the third embodiment with comparing to the first embodiment, as a bonding structure between the rubber 25 and the transmit operational plate 24 is different and the other constitutions are the same as the first embodiment, the different points only will be described in detail, the same points will be omitted suitably, and the same signature will be attached to the same components, too.

Specifically, in addition to the first example, the display screen switch of the third embodiment in a bonding surface with the rubber 25 and the transmit operational plate 24, a fine concave and convex form 51 such as satin finish is formed on the transmit operational plate 24.

Figure 7:
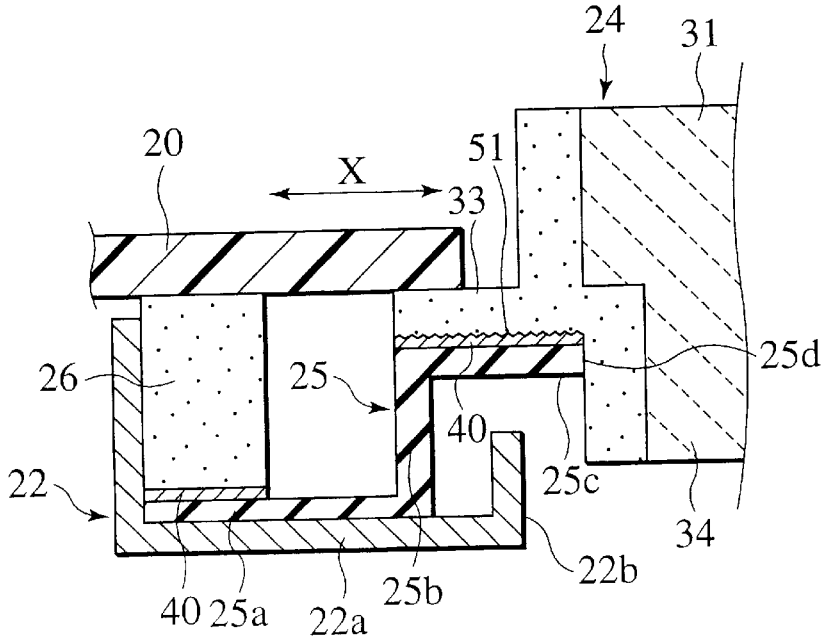
FIG. 7 is a mainly enlarged cross-sectional view of the display screen switch according to a third embodiment of the present invention.
Figure 8:
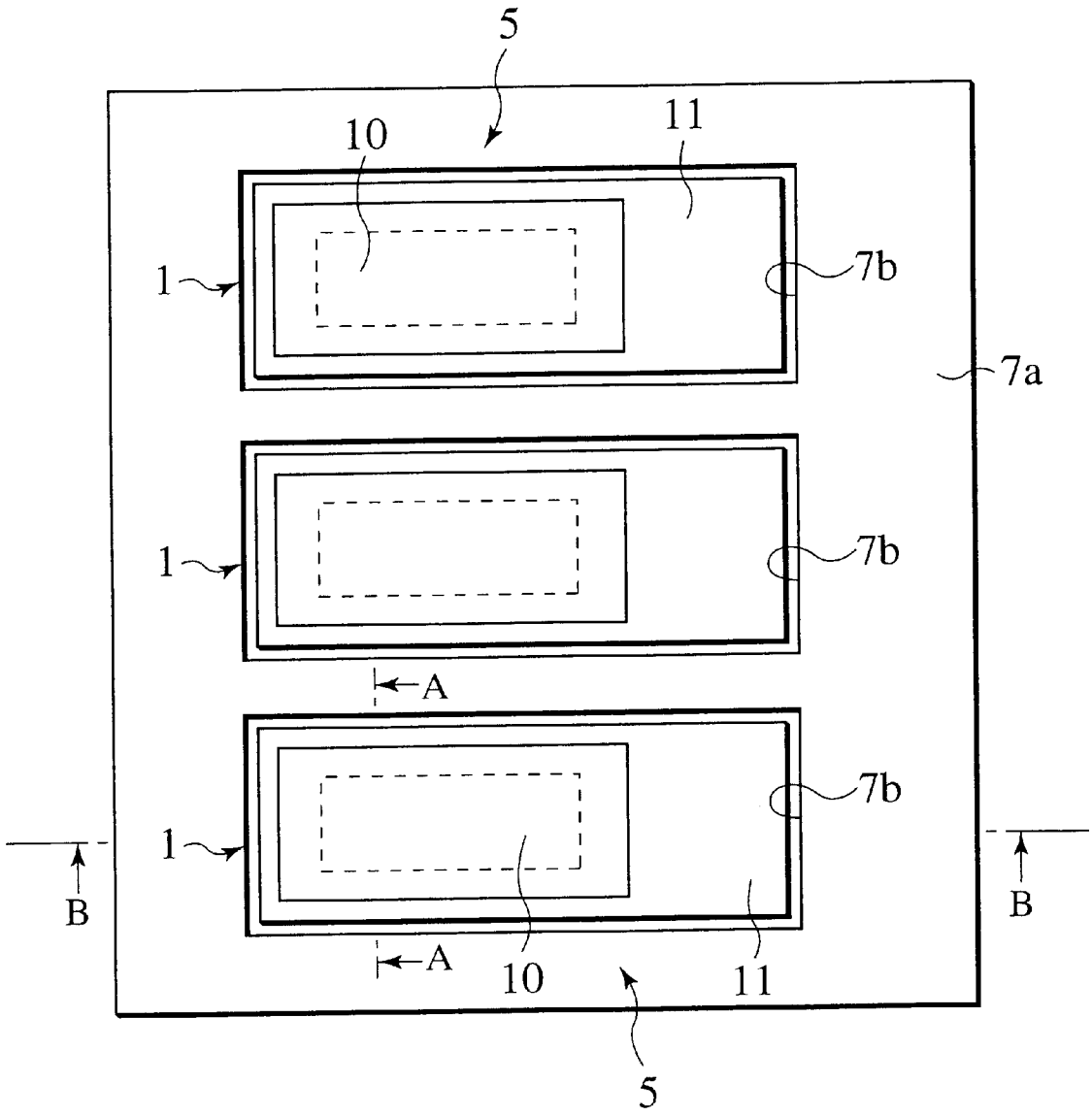
FIG. 8 is a front elevation of a display screen switch which the present inventors previously proposed (not prior art).
Figure 9:
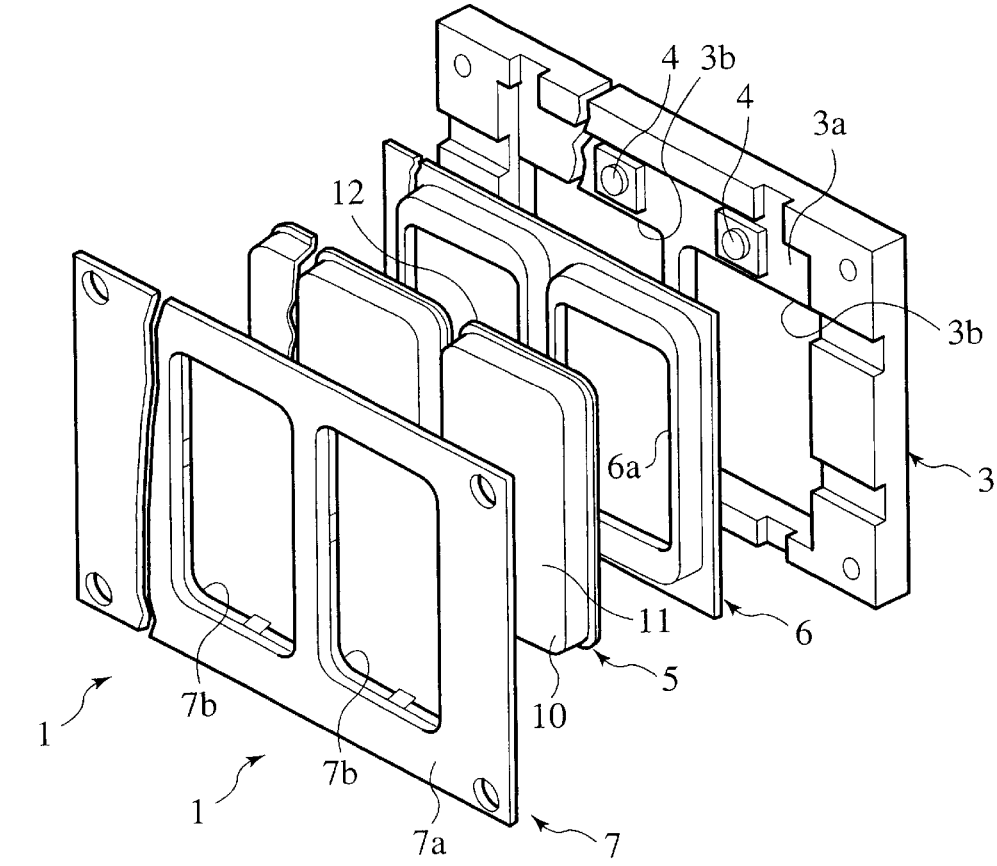
FIG. 9 is an exploded perspective view of the display screen switch shown in FIG. 8.
Figure 10:
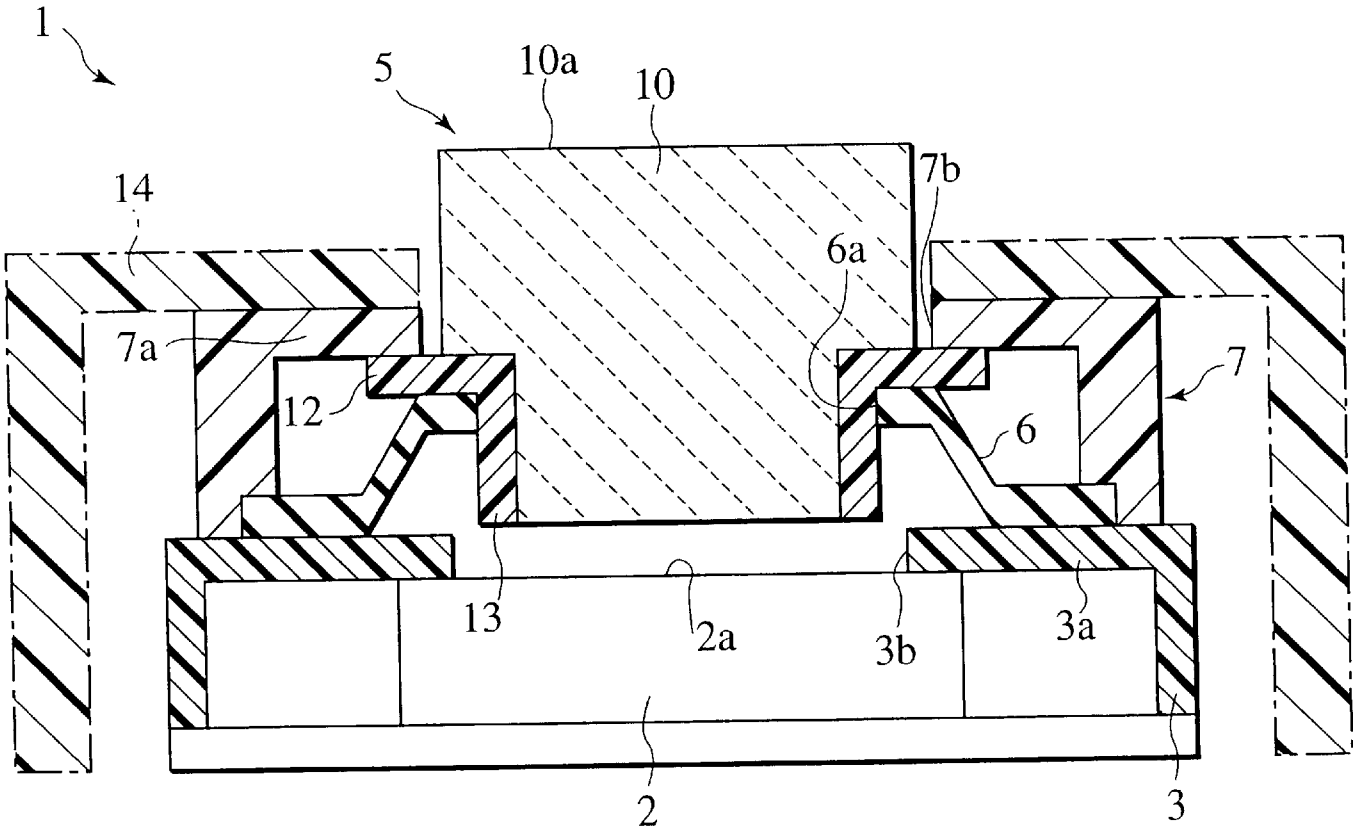
FIG. 10 is an enlarged cross-sectional view along A—A line in FIG. 8.
Figure 11:
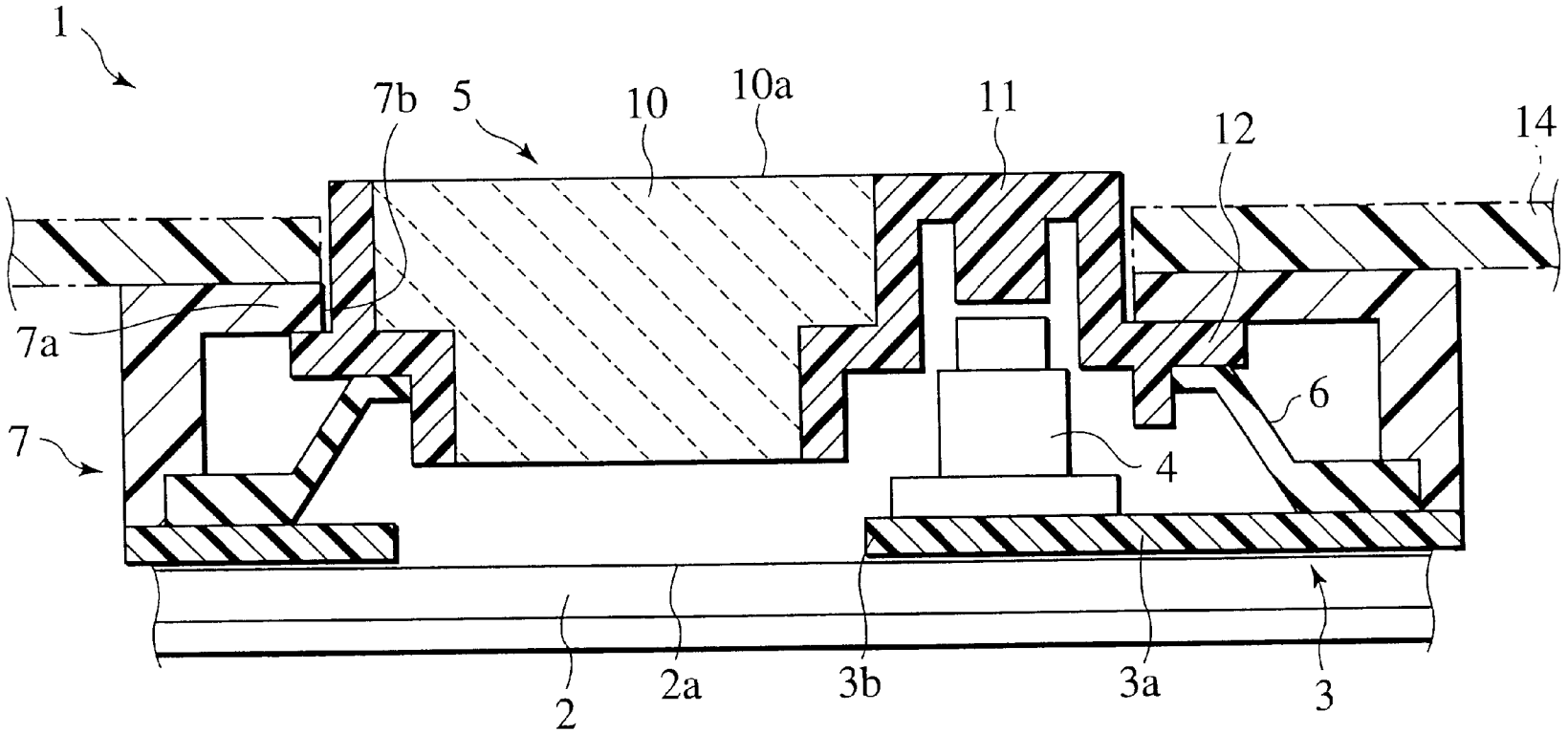
FIG. 11 is a cross-sectional view along B—B line in FIG. 8.

Therefore, according to the third embodiment, since each bonding area between the rubber 25 and the transmit operational plate 24 is widened, an attaching force in a direction indicated by an arrow X in FIG. 7 can be increased and peeling strength can be enhanced the more, too.

Further, in the third embodiment, a processing such as satin finish may be effected to the rubber 25 or both to the rubber 25 and the transmit operational plate 24.

And, in each of the above embodiments, primer processing may be performed on at least one of opposite faces of the rubber 25 and the transmit operational plate 24 to enhance the attaching strength between the rubber 25 and the transmit operational plate 24. Of course, such primer processing may be combined with the above concave and convex processing or the satin finish one.

In the above embodiments, the display screen switch 21 which is applied to an on-vehicle electrical equipment A is typically described, but of course, it is also applied to a device other than the on-vehicle electrical equipment, preferably.

Further, in the above embodiment, the liquid crystal display 19 is used as a display means, but the present invention is not limited to these kinds, but even if many sorts of information can be displayed on the display screen 19*a*, it will do. For example, a cathode ray tube or the like may be utilized for a display means.

In the above embodiments, an elastic member having a light transmission capability is constructed by the rubber 25. Nevertheless, if a member can be interposed between the transmit operational plate 24 and the case 22, and it has a necessary elasticity, bonding capability and light transmission capability, it is not limited to the rubber.

It is to be understood that the above-mentioned structures in the certain embodiments are merely illustrative of the principles of the present invention and also that many variations may be devised by those skilled in the art without departing from the spirit and the scope of the present invention.

What is claimed is:

1. A display screen switch comprising:

a plate-like case arranged on a display screen and provided with a transmit-light window part in which switch information displayed on the display screen is transmitted;

a switch body fixed to the case;

a cover arranged on an upper side of the case and having a hole part;

a transmit operational member including a transparent display part which transmits a visible light and on which the switch information is displayed, and a switch push-down part which makes the switch body operate, the transmit operational member being structured such that the transparent display part and the switch push-down part are arranged in a protruding way from the hole part between the cover and the case; and an elastic member interposed between the transmit operational member and the case along a circumference part of the transmit operational member; wherein the elastic member and the transmit operational member are bonded by an adhesive.

2. A display screen switch according to claim 1, wherein a base positioned in the case is arranged between the cover and the elastic member and the base and the elastic member is bonded by an adhesive.

3. A display screen switch according to claim 2, wherein the adhesive bonding the elastic member and the transmit operational member and/or that bonding the base and the elastic member are ultraviolet light hardening adhesive.

4. A display screen switch according to claim 1, wherein at a bonding surface between the elastic member and the transmit operational member, in at least one of the elastic member and the transmit operational member is arranged a convex part, and in the other is arranged a concave part corresponding to the convex part.

5. A display screen switch according to claim 1, wherein at a bonding surface between the elastic member and the transmit operational member, a fine irregularity is formed in at least one of the elastic member and the transmit operational member.

6. A display screen switch according to claim 3, wherein the elastic member has an optical characteristic such that transmits an ultraviolet light hardening the ultraviolet light hardening adhesive.

7. A display screen switch according to claim 6, wherein the ultraviolet light hardening the ultraviolet light hardening adhesive can be attained to the ultraviolet hardening adhesive through the elastic member.

8. A display screen switch according to claim 1, wherein the case is processed to restrain a reflection of visible light.

9. A display screen switch according to claim 1, wherein the transmit operational member has an opaque part for visible light around the transmit operational member.

10. A display screen switch according to claim 1, wherein the elastic member is arranged in a compressed state between the transmit operational member and the case.

11. A display screen switch according to claim 1, wherein the elastic member has a lower face part contacting with the case, a stand-mounting part standing from the lower face part, and an upper face part situated on an upper side of the stand-mounting part and contacts with the transmit operational member, and the stand-mounting part which is situated on the opposite side of the switch push-down part in the transmit operational member is thick, while the stand-mounting part which is situated on the side of the switch push-down part of the transmit operational member is thin.

* * * * *